US007440717B2

(12) United States Patent
Kubota et al.

(10) Patent No.: US 7,440,717 B2
(45) Date of Patent: Oct. 21, 2008

(54) DEVELOPING APPARATUS AND IMAGE FORMING APPARATUS WITH TONER SUPPLY PORTION OPENING/CLOSING MECHANISM

(75) Inventors: Hiroshi Kubota, Kadoma (JP); Yasuyuki Ishiguro, Higashiosaka (JP); Jun Yamaguchi, Ikoma (JP); Hiroshi Kawahito, Kitakatsuragi-gun (JP); Yusuke Yoshimoto, Yamatotakada (JP)

(73) Assignee: Sharp Kabushiki Kaisha, Osaka (JP)

( * ) Notice: Subject to any disclaimer, the term of this patent is extended or adjusted under 35 U.S.C. 154(b) by 80 days.

(21) Appl. No.: 11/518,903

(22) Filed: Sep. 12, 2006

(65) Prior Publication Data

US 2007/0059045 A1 Mar. 15, 2007

(30) Foreign Application Priority Data

Sep. 12, 2005 (JP) ..... P2005-264091

(51) Int. Cl.
*G03G 15/08* (2006.01)

(52) U.S. Cl. ..... 399/258; 399/119; 399/260

(58) Field of Classification Search ..... 399/258, 399/260, 119, 120; 222/DIG. 1
See application file for complete search history.

(56) References Cited

U.S. PATENT DOCUMENTS

| | | | | |
|---|---|---|---|---|
| 5,128,724 | A * | 7/1992 | Hayashi et al. | 399/119 |
| 6,782,235 | B2 * | 8/2004 | Serizawa et al. | 399/120 X |
| 2005/0226656 | A1 * | 10/2005 | Tsuda et al. | 399/258 |
| 2005/0281590 | A1 | 12/2005 | Tsuda et al. | 399/258 |
| 2006/0193659 | A1 * | 8/2006 | Tanda | 399/258 |
| 2006/0228134 | A1 * | 10/2006 | Ishiguro et al. | 399/258 |
| 2007/0081835 | A1 | 4/2007 | Tsuda et al. | 399/258 |

FOREIGN PATENT DOCUMENTS

| | | | |
|---|---|---|---|
| CN | 1527157 | A | 9/2004 |
| JP | 03-264979 | A * | 11/1991 |
| JP | 06-167879 | A * | 6/1994 |
| JP | 7-210048 | | 11/1995 |
| JP | 2000-019914 | A * | 1/2000 |
| JP | 2002-268357 | | 9/2002 |
| JP | 2005-338583 | A * | 12/2005 |

* cited by examiner

*Primary Examiner*—Sophia S Chen
(74) *Attorney, Agent, or Firm*—Nixon & Vanderhye, P.C.

(57) ABSTRACT

In the developing apparatus including a developing bath and a toner transport pipe for supplying toner to the developing bath, a toner supply portion opening/closing mechanism is provided, that includes a shutter member for opening and closing a toner supply port of the toner transport pipe that is contained in a base portion of the toner transport pipe, a shaft for moving the shutter member back and forth in a longitudinal direction of the developing bath, a second spring member provided such that the shaft is inserted therein, a first spring member for supporting the shaft detachably to the shutter member through its extension and contraction, and a lever member for extending and contracting the first spring member through its releasing and closing.

4 Claims, 8 Drawing Sheets

DEVELOPING APPARATUS AND IMAGE FORMING APPARATUS WITH TONER SUPPLY PORTION OPENING/CLOSING MECHANISM

BACKGROUND OF THE INVENTION

1. Field of the Invention

The present invention relates to a developing apparatus and an image forming apparatus provided with the same.

2. Description of the Related Art

Electrophotography, which can form high quality images easily, is widely used for image forming apparatuses such as copiers, printers, and facsimiles. Electrophotographic image forming apparatuses are generally configured including a photoreceptor drum containing photoconductive substances, a charging section, an exposure section, a developing section, a transfer section and a fixing section. The charging section uniformly charges the surface of a photoreceptor drum. The exposure section irradiates the charged surface of the photoreceptor drum with light based on image information to form an electrostatic latent image. The developing section supplies toner to the electrostatic latent image on the surface of the photoreceptor drum to convert the image to a visible image. The transfer section transfers the toner image carried on the surface of the photoreceptor drum on the surface of a recording medium. The fixing section fixes the toner image on the recording medium to the recording medium by heating, applying pressure or the like.

In general, a developing apparatus including a developing portion and a toner replenishing portion is used as the developing section. The developing portion is configured including a developing roller, a doctor blade, a stirring roller and a developing bath. The developing roller is provided in contact with the photoreceptor drum and includes a developing roller that carries a toner layer on its surface and supplies toner to an electrostatic latent image. The doctor blade is a plate-like member that abuts against the surface of the developing roller for regulating the thickness of the toner layer on the surface of the developing roller. The stirring roller charges toner by being driven to rotate and supplies the charged toner to the circumference of the developing roller. The developing bath that contains the developing roller, the doctor blade and the stirring roller and contains the toner. In the developing portion, the electrostatic latent image on the photoreceptor drum is converted to a visual image with the toner. Furthermore, the toner replenishing portion includes a toner hopper (or toner cartridge) and a toner transport pipe. The toner hopper is provided above the developing bath for storing toner. The toner transport pipe is provided between the toner hopper and the developing path so as to connect the two members, serving as a toner transport path for replenishing the developing bath with the toner in the toner hopper.

In the conventional image forming apparatus, when there is no more toner left even in the toner replenishing portion, only the toner hopper cartridge is replaced while the developing portion and the toner transport pipe remain as they are. In a portion of the toner hopper to which the toner transport pipe is attached, a toner replenishing port through which the toner is supplied to the toner transport pipe is provided, and further a shutter member for opening and closing the toner replenishing port is provided. The shutter member opens the toner replenishing port by attaching the toner hopper to the toner transport pipe. Therefore, at the same time when the toner hopper is attached to the toner transport pipe, the toner in the toner hopper is supplied to the developing bath through the toner transport pipe.

Such a shutter member can be used also in other apparatuses than the toner hopper, for example, in a toner reuse apparatus that has a toner receiving portion and a toner transporting portion and returns toner collected by a toner cleaner from the surface of the photoreceptor drum (see Japanese Unexamined Patent Publication JP-A 7-210048 (1995), for example) . Here, the toner receiving portion is supported by the developing bath and is provided with a toner receiving portion in its upper portion, and is provided such that the inner space of the toner receiving portion connecting to the toner receiving portion is in communication with the inner space of the developing bath. Furthermore, the toner transporting portion, which extends in the vertical direction, has an upper end portion and a lower end portion, and is a hollow member attachable to the toner receiving portion. A toner cleaner is connected to the upper end portion and a shutter member is provided so as to be a buttable against the toner receiving port in the lower end portion. In this toner reuse apparatus, when the toner transporting portion abuts against the toner receiving portion, the shutter member is opened abutting against the toner receiving port, and the inner space of the toner transporting portion is in communication with the inner space of the toner receiving portion via the toner receiving port, so that the toner falls from the lower end portion of the toner transporting portion and is supplied to the developing bath. When the toner transporting portion is separated from the toner receiving portion, the shutter member is not opened, so that the toner does not fall from the lower end portion of the toner transporting portion.

In the toner hopper and the toner reuse apparatus disclosed in the JP-A 7-210048, when the shutter member is opened, the toner in the toner hopper or the toner cleaner falls to the developing bath at once. Since toner is fine powder having a particle size of micron order, due to the reaction of falling, the toner leaks to the inside of the image forming apparatus from the portion in which the toner transport pipe is connected to the developing bath, a portion in which the toner transporting portion is connected to the toner receiving portion or other portions and scatters, and thus contaminates the inner portion of the image forming apparatus. The contamination in the inner portion of the image forming apparatus tends to cause poor image forming operation, defects in formed images, soil in unused recording media, high burden on maintenance and the like, and therefore there is a demand for reducing toner contamination.

Furthermore, at present, a developing apparatus employing a two-component developer containing toner and carrier is widely used while the life of the image forming apparatus is increased, resulting in a problem of long term durability of carrier filled in the developing bath of the developing apparatus, which necessitates replacement of a developing apparatus itself that is provided in the form of a cartridge. However, even when the shutter member is provided in a portion where the toner transport pipe abuts against the developing apparatus, toner may scatter and contaminate the inner portion of the image forming apparatus at the moment when the developing apparatus is detached from the toner transport pipe for replacement.

When the developing apparatus and the toner transport pipe is formed into one piece, toner can be preventing from scattering, but this requires significant labor and high cost for production, and is not suitable for industrial mass production.

SUMMARY

A developing apparatus is provided from which toner does not scatter to the inner portion of the image forming apparatus even if a toner replenishing container such as the toner hopper or the developing apparatus is replaced, and an image forming apparatus provided with the same.

A developing apparatus comprises:

a developing bath that receives supply of toner from a toner replenishing container;

a toner transport pipe provided between the toner replenishing container and the developing bath, in which a toner supply port for supplying toner to the developing bath is formed; and a toner supply port opening/closing mechanism for opening and closing the toner supply port.

A developing apparatus comprises a developing bath that receives supply of toner from a toner replenishing container, a toner transport pipe provided between the toner replenishing container and the developing bath, in which a toner supply port for supplying toner to the developing bath is formed, and a toner supply port opening/closing mechanism for opening and closing the toner supply port. A configuration is adopted in which after the toner supply port of the toner transport pipe is closed, the toner replenishing container is replaced. Furthermore, toner replenishment from a newly fitted toner replenishing container is performed by supplying toner in two stages: supplying toner from the toner replenishing container to the inner space of the toner transport pipe; and further opening the toner supply port of the toner transport pipe by the toner supply port opening/closing mechanism to replenish the developing bath with toner. Therefore, the toner does not fall from the toner replenishing container to the developing bath at once. Consequently, scattering of toner due to momentum of toner falling can be significantly suppressed when the toner replenishing container or the developing apparatus is detached from and attached to the image forming apparatus, and toner scattering does not occur to the extent that the inner portion of the image forming apparatus is contaminated.

It is preferable that the toner supply portion opening/closing mechanism comprises:

a shutter member provided so as to be capable of moving back and forth in a direction perpendicular to an axis of the toner transport pipe, for opening and closing the toner supply port;

a shaft provided detachably to the shutter member, for moving the shutter member back and forth;

a first spring member provided in contact with the shaft, for supporting the shaft such that the shaft is detachable to the shutter member through its extension and contraction; and a lever member that is provided so as to be capable of being released and closed, that abuts against the first spring member when closed, and extends and contracts the first spring member through its releasing and closing.

It is preferable that the toner supply portion opening/closing mechanism comprise a shutter member provided so as to be capable of moving back and forth in a direction perpendicular to an axis of the toner transport pipe, for opening and closing the toner supply port; a shaft provided detachably to the shutter member, for moving the shutter member back and forth; a first spring member provided in contact with the shaft, for supporting the shaft such that the shaft is detachable to the shutter member through its extension and contraction; and a lever member that is provided so as to be capable of being released and closed, that abuts on the first spring member when closed, and extends and contracts the first spring member through its releasing and closing. By adopting such a simple configuration, occurrence of toner scattering at the time of removing or attaching the toner replenishing container or the developing apparatus can be even further suppressed, and an operation for preventing toner scattering can be performed reliably even in a long term repeated use, and the toner supply port opening/closing mechanism is easily formed, which is industrially advantageous.

It is preferable that the toner supply port opening/closing mechanism closes the toner supply port by separating the shaft from the shutter member at the time of releasing the lever member, and the toner supply port opening/closing mechanism opens the toner supply port by bringing the shaft into contact with the shutter member at the time of closing the lever member.

The toner supply port opening/closing mechanism performs so as to close the toner supply port by separating the shaft from the shutter member at the time of releasing the lever member, and open the toner supply port by bringing the shaft into contact with the shutter member at the time of closing the lever member. Thus, the lever member is released at the time of removing and attaching the toner replenishing container or the developing apparatus, so that the lever member cannot obstruct various operations for image formation, so that the toner replenishing container or the developing apparatus can be removed or attached smoothly.

It is preferable that the toner supply port opening/closing mechanism comprises a second spring member that is provided such that the shaft is inserted therein, and that bias the shaft to separate from the shutter member at the time of releasing the lever member.

By configuring the toner supply port opening/closing mechanism so as to include a second spring member that is provided such that the shaft is inserted therein, and that bias the shaft to separate from the shutter member at the time of releasing the lever member, the operating of closing the toner supply port at the time of removing and attaching the toner replenishing container or the developing apparatus can be performed further reliably, and toner scattering can be further prevented.

An image forming apparatus is provided with a developing apparatus which, even when used for a long time, toner scattering and consequently contamination in the inner portion of the apparatus with toner hardly occurs when the toner replenishing container or the developing apparatus is replaced.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
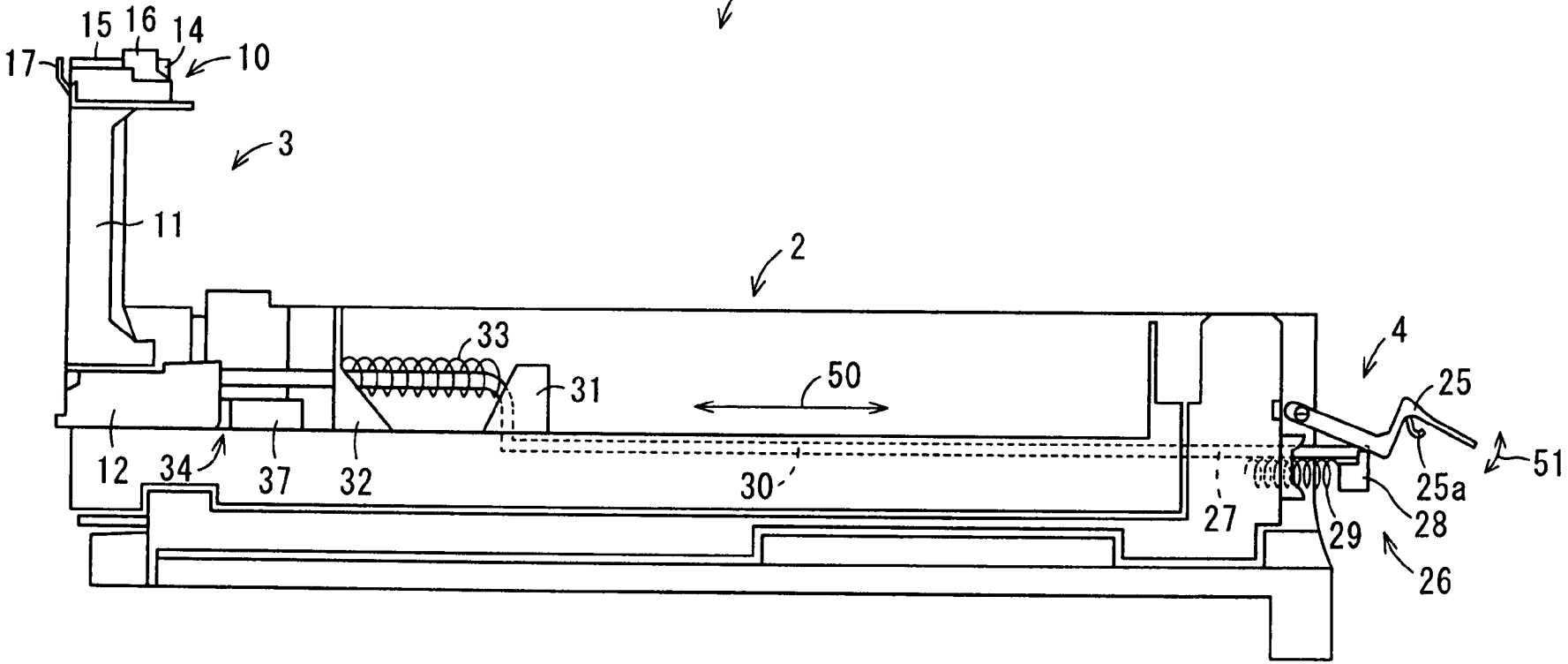
FIG. 1 is a side view schematically showing the structure of a developing apparatus according to a first example embodiment.

Now referring to the drawings, preferred embodiments are described below.

Figure 2:
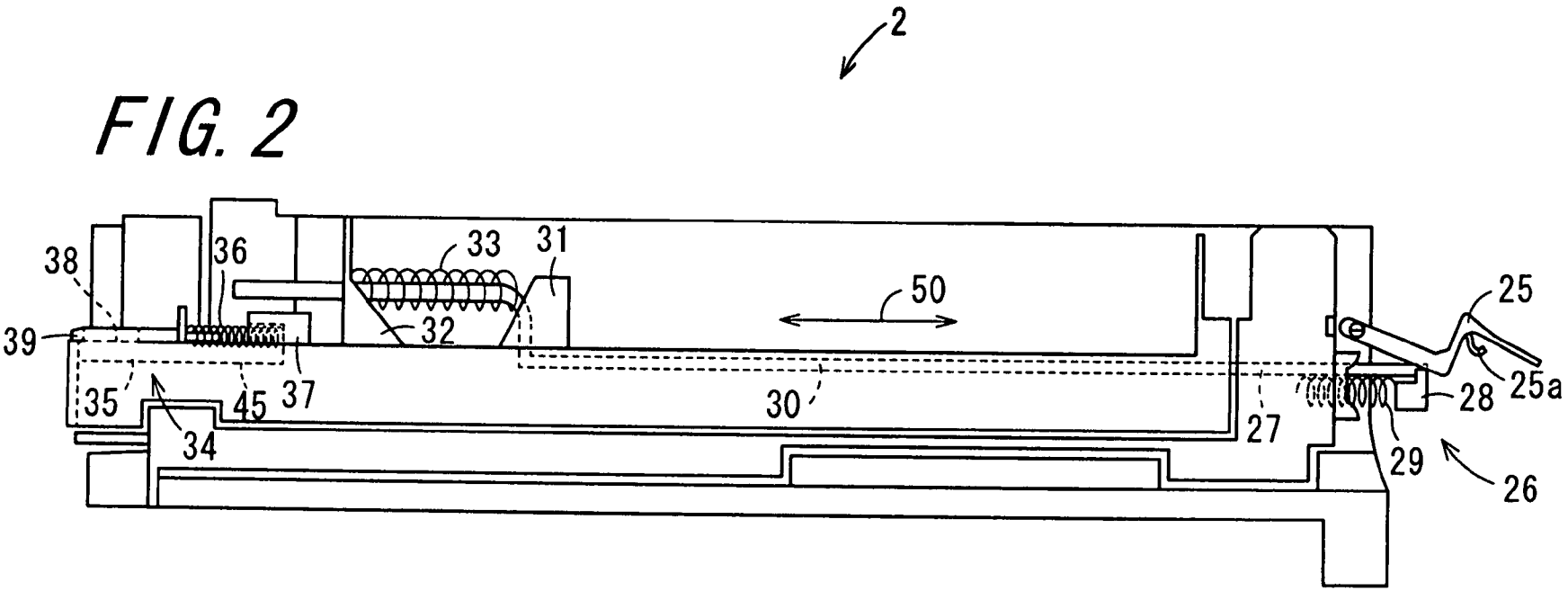
FIG. 2 is a side view schematically showing the structure of a relevant portion of the developing apparatus shown in FIG. 1.
Figure 3:
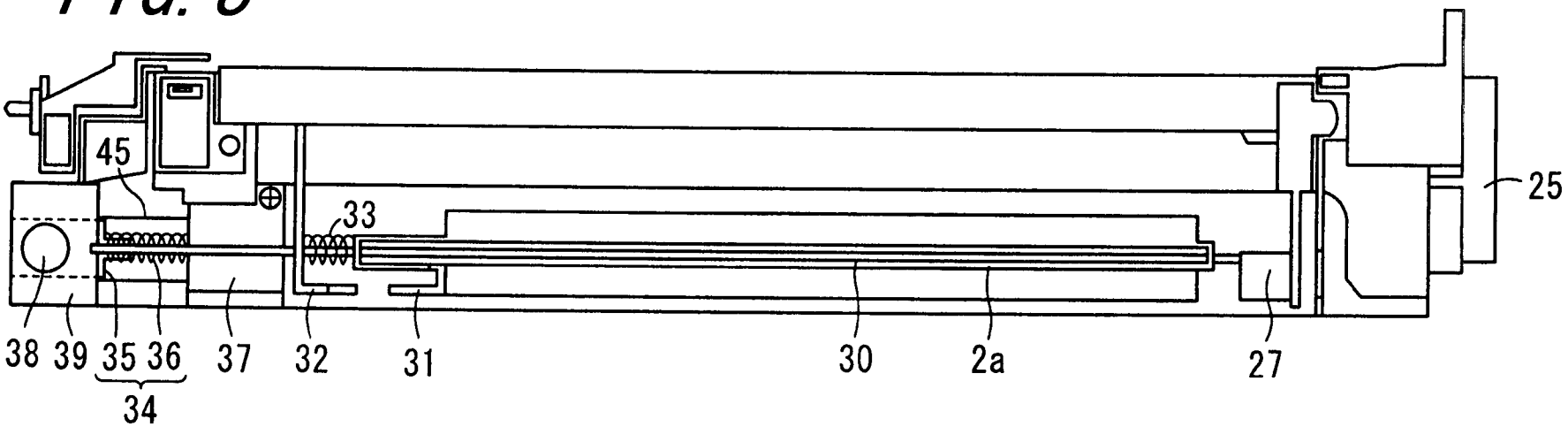
FIG. 3 is a top view schematically showing the structure of the relevant portion of the developing apparatus shown in FIG. 1.
Figure 4:
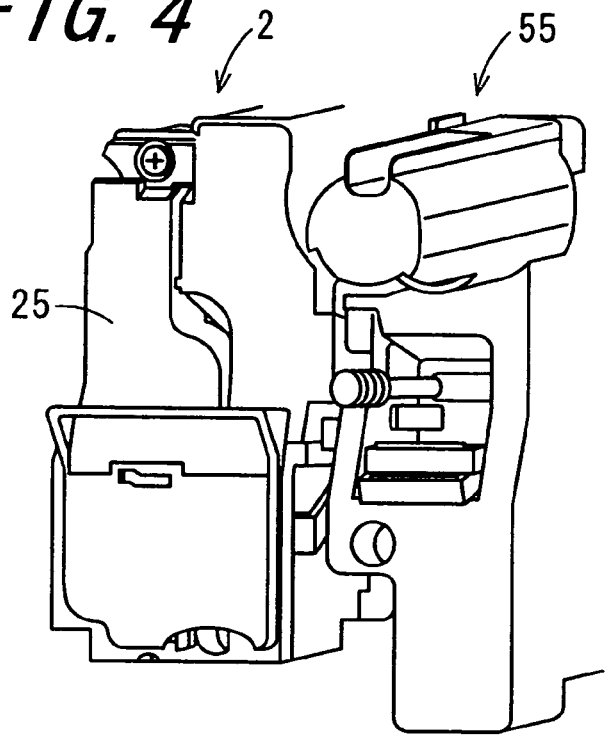
FIG. 4 is a perspective view showing a state in which a lever member is closed.
Figure 5:
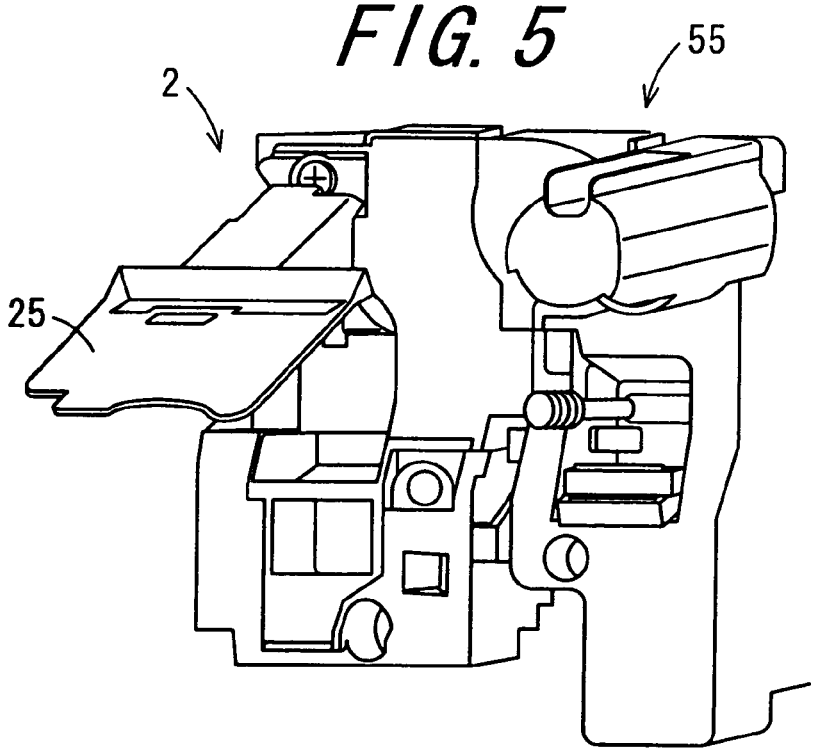
FIG. 5 is a perspective view showing a state in which the lever member is released.
Figure 6A:
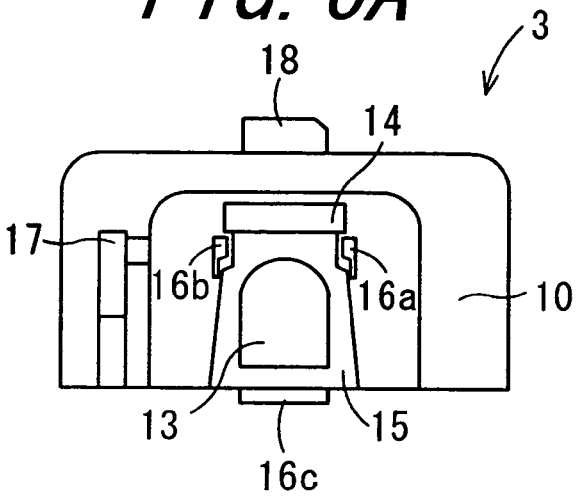
FIGS. 6A to 6D are views schematically showing the structure of a toner transport pipe, FIG. 6A being a top view, FIG. 6B being a side view, FIG. 6C being a bottom view, and FIG. 6D being a partial front view.
Figure 6B:
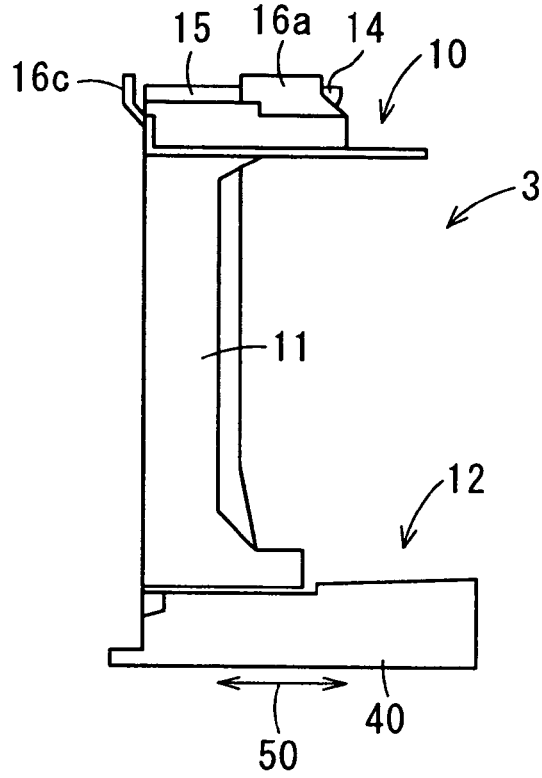
Figure 6C:
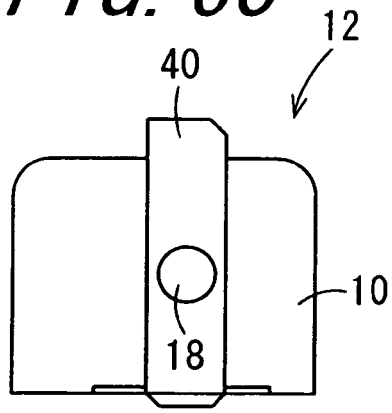
Figure 6D:
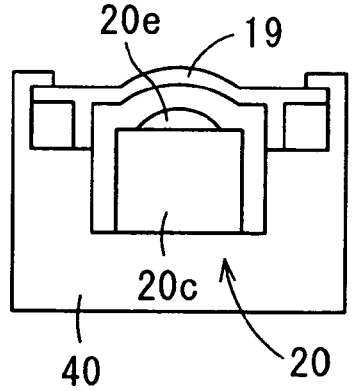
Figure 7A:
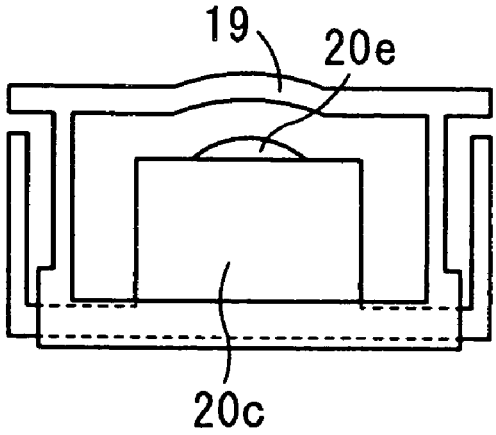
FIGS. 7A to 7C are views schematically showing the structure of a shutter member, FIG. 7A being a front view, FIG. 7B being a bottom view, and FIG. 7C being a side view.
Figure 7B:
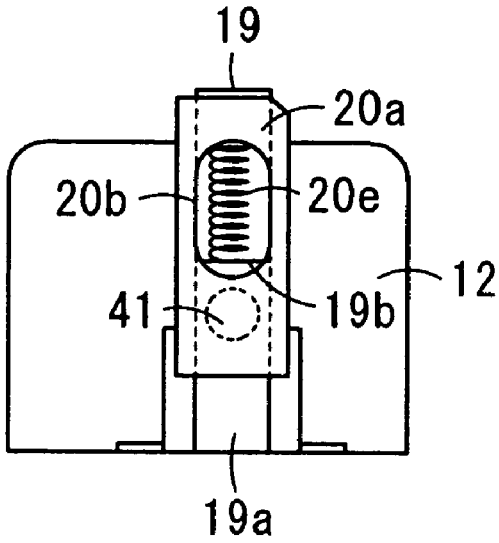
Figure 7C:
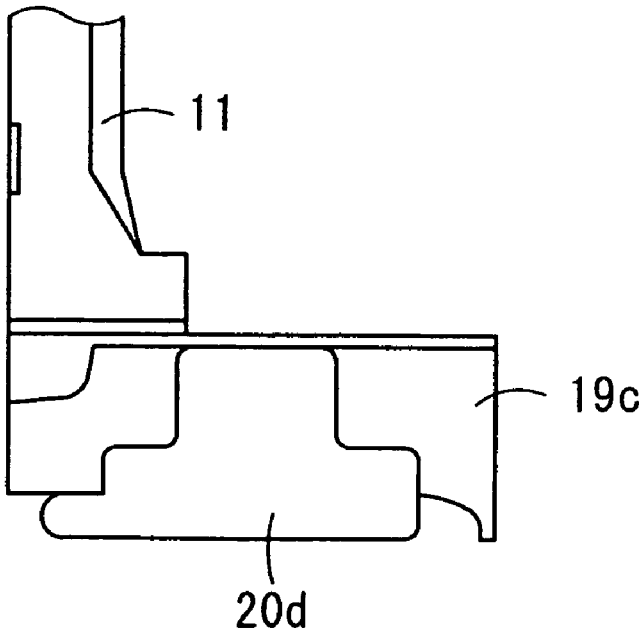
Figure 8:
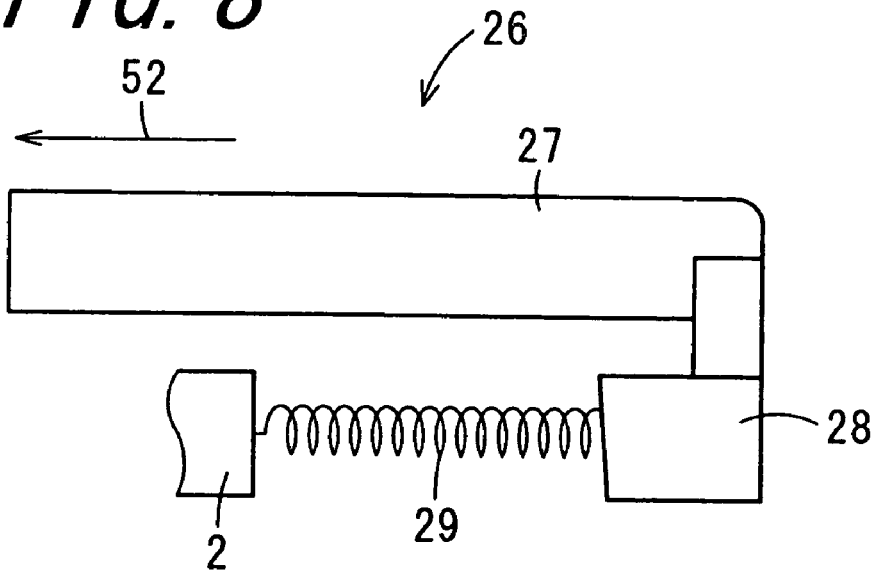
FIG. 8 is a side view schematically showing the structure of a first spring member.
Figure 9:
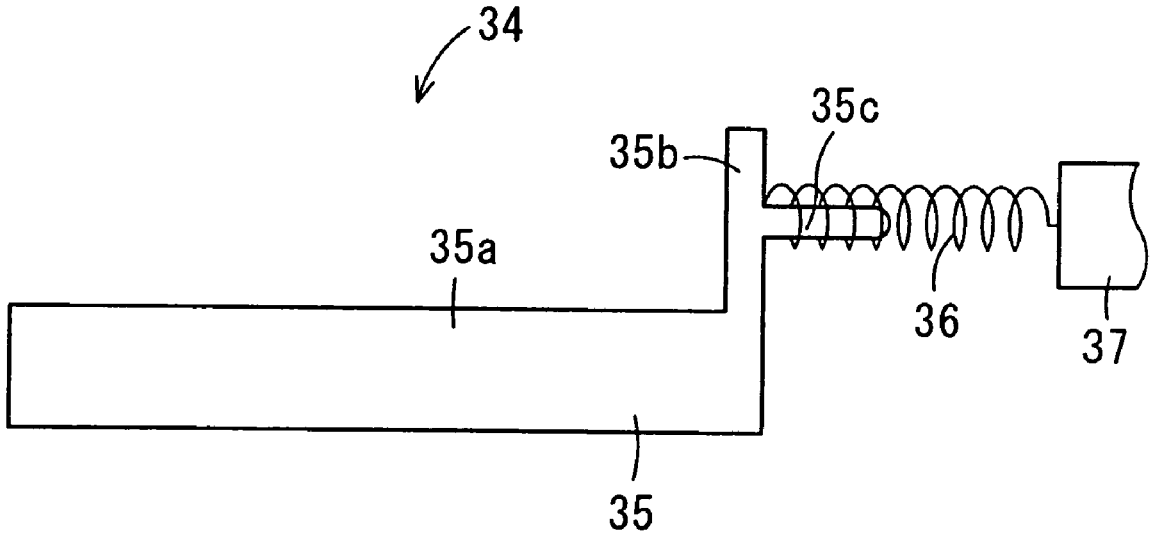
FIG. 9 is a side view schematically showing the structure of a shutter mechanism.

FIG. 1 is a side view schematically showing the structure of a developing apparatus 1 according to a first example embodiment. FIG. 2 is a side view schematically showing the structure of a relevant portion of the developing apparatus 1 shown in FIG. 1. FIG. 3 is a top view schematically showing the structure of the relevant portion of the developing apparatus 1 shown in FIG. 1. FIG. 4 is a perspective view showing a state in which a lever member 25 is closed. FIG. 5 is a perspective view showing a state in which the lever member 25 is released. FIGS. 6A to 6D are views schematically showing the structure of a toner transport pipe 3, FIG. 6A being a top view, FIG. 6B being a side view, FIG. 6C being a bottom view, and FIG. 6D being a front view of a lower end portion 12 in the toner transport pipe 3. FIGS. 7A to 7C are views schematically showing the structure of a shutter member 20, FIG. 7A being a front view, FIG. 7B being a bottom view, and FIG. 7C being a side view. FIG. 8 is a side view schematically showing the structure of a first spring member 26. FIG. 9 is a side view schematically showing the structure of a shutter mechanism 34.

The developing apparatus 1 includes a developing bath 2 that is replenished with toner from a toner hopper , which is a toner replenishing container, a toner transport pipe 3 that is provided between the unshown toner hopper and the developing bath 2 and provided with a toner supply port 18 for supplying toner to the developing bath 2, and toner supply port opening and closing mechanism 4 for opening and closing the toner supply port 18.

The developing bath 2 is provided with a toner receiving port 38 that receives the supply of toner on a surface of one end portion in the longitudinal direction, supplies to the toner transported and supplied from the toner hopper to an electrostatic latent image formed on the surface of a photoreceptor drum (not shown) to develop the electrostatic image. The developing bath 2 is a container-like member made of, for example, resin, and contains toner in its inner space, and further contains a developing roller, a thickness regulating member, a supply roller and a stirring transporting member (not shown).

As shown in FIGS. 2 and 3, the toner receiving port 38 is formed at a position that is in communication with the toner supply port 18 formed on the bottom face of the toner transport pipe 3 in the vertical direction when the developing bath 2 is connected to the toner transport pipe 3. A buffer member 39 is provided surrounding the toner receiving port 38. The buffer member 39 further ensures the connection of the developing bath 2 and the toner transport pipe 3, and prevents toner from leaking from the connection portion thereof.

Furthermore, a shutter mechanism 34 for opening and closing the toner receiving port 38 is provided in the toner receiving port 38. As shown in FIGS. 2, 3 and 9, the shutter mechanism 34 includes a closing member 35, a spring 36 and a supporting member 37. The closing member 35 opens and closes the toner receiving port 38 by moving back and forth in the longitudinal direction of the developing bath 2. The closing member 35 includes a bottom plate 35*a*, a wall plate 35*b* and a protrusion 35*c* (see FIG. 9). The bottom plate 35*a* abuts against the toner receiving port 38 in the inner wall of the developing bath 2 and is in a recess 45 formed extending in the longitudinal direction of the developing bath 2 on the surface of the developing bath 2 and can move back and forth in the longitudinal direction of the developing bath 2. The wall plate 35*b* is formed extending in the direction perpendicular to the bottom plate 35*a* from the end portion opposite to the side of the bottom plate 35*a* facing the toner receiving port 38. The protrusion 35*c* extends in the longitudinal direction of the developing bath 2 from the side face opposite to the side face of the wall plate 35*b* that is connected to the bottom plate 35*a*. The spring 36 is fixed to the protrusion 35*c* of the closing member 35 at one end and supported by a supporting member 37 at the other end. The supporting member 37 is provided projecting outward from the surface of the developing bath 2, and has an inner space that can contain the spring 36 when the spring 36 is contracted and fixes one end of the spring 36 to the inner wall of the inner space to support the spring 36. The toner receiving port 38 is closed with the shutter mechanism 34 with the spring 36 stretched when the toner transport pipe 3 is not attached. When the toner transport pipe 3 is attached, the spring 36 is contracted by the wall plate 35*b* in the shutter mechanism 34 being pressed by the toner transport pipe 3 while the bottom plate 35*a* moves in the recess 45 in the direction to which the bottom plate 35*a* moves away from the toner receiving port 38 so that the toner receiving port 38 is opened.

That is to say, in the state where the toner transport pipe 3 is attached to the developing bath 2, the toner receiving port 38 of the developing bath 2 is opened.

The developing roller is a roller member that faces the photoreceptor drum via an opening portion (not shown) formed opposed to the photoreceptor drum in the developing bath 2 and is supported rotatably by the developing bath 2 such that the axis of the photoreceptor drum is in parallel to the axis of the developing roller, and is driven to rotate around the axis by driving mechanism (not shown).

The thickness regulating member is a thin plate-like member made of, for example, an elastic material such as metal and resin, and is provided such that one end potion thereof is attached to the developing bath 2 and the vicinity of the other free end abuts against the developing roller. The thickness regulating member adjusts the thickness of a toner layer carried on the surface of the developing roller to a desired value.

The supply roller is a roller member that is supported rotatably by the developing bath 2 so as to abut against the developing roller, is driven to rotate around the axis by a driving mechanism (not shown), and supplies toner to the developing roller by conveying toner contained in the inner space of the developing bath 2 by being driven to rotate.

The stirring transport member is a roller member that is provided at a position opposed to the developing roller via the supply roller and supported rotatably by the developing bath 2, is driven to rotate around the axis by a driving mechanism (not shown), and transports toner to the supply roller while stirring toner supplied to the developing bath 2 by being driven to rotate.

Furthermore, a constituent member that is commonly used in the developing bath 2 such as a toner concentration detecting sensor (not shown) may be provided in the developing bath 2.

A photoreceptor 55 is provided adjacent to the developing bath 2.

With the developing bath 2, the toner supplied to the developing bath 2 is supplied to the circumference of the developing roller by the stirring transport member and the supply roller being driven to rotate, so that a toner layer is formed on the surface of the developing roller, and the thickness of the toner layer is regulated by the thickness regulating member and then toner is supplied to an electrostatic latent image on the photoreceptor drum.

As shown in FIGS. 6A to 6D, the toner transport pipe 3 includes a top portion 10, abase portion 12 and a toner transport portion 11. The top portion 10 has a toner replenishing port 13 that receives replenishment of toner from a toner hopper (not shown). The base portion 12 has a toner supply portion 18 for supplying toner to the developing bath 2. The toner transport portion 11 is provided extending in the vertical direction, is connected to the top portion 10 at one end and connected to the base portion 12 at the other end. The toner transport portion 11 has an inner space formed such that the toner replenishing port 13 is in communication with the toner supply port 18, and transports toner supplied from the toner replenishing port 13 to the toner supply port 18.

Buffer members 14 and 15 are provided surrounding the toner replenishing port 13 formed on the upper surface of the top portion 10, and fitting assembly 16 (comprising fitting members 16*a*, 16*b*, 16*c* and 17) is further provided in the periphery thereof. The buffer members 14 and 15 are members for ensuring connection with the toner hopper and prevents toner from the leaking from the connection portion, and are made of, for example, an elastic substance such as rubber, resin or foams thereof. The fitting members 16*a*, 16*b*, 16*c* and 17 are protrusion members formed expending outward from the upper surface of the top portion 10 and are fitted into a fitting recess of the toner hopper (not shown) so as to connect the top portion 10 of the toner transport pipe 3 and the toner hopper.

The toner transport portion 11 is a hollow member having an inner space as described above.

The base portion 12 includes a base portion main body 19 that is integrally formed with the toner transport portion 11 and a protective member 40 that is provided removably with respect to the base portion main body 19 and protects the base portion main body 19.

As shown in FIGS. 7A to 7C, the base portion main body 19 has an inner space (not shown) that is in communication with the inner space of the toner transport portion 11. The inner space penetrates the base portion main body 19 in the vertical direction, opens outward in the bottom surface 19*a* of the base portion main body 19 so that an opening portion 41 is formed.

Furthermore, the base portion main body 19 supports a shutter member 20 such that the shutter member 20 can move back and forth in the direction shown by an arrow 50 (see FIG. 6B) (i.e., the direction perpendicular to the axis of the toner transport pipe 3).

The shutter member 20 is a member for opening and closing directly the toner supply port 18 of the toner transport pipe 3 by moving back and forth in the direction shown by the arrow 50 by a shaft 30 moving back and forth, and functions as a part of the mechanism 4 for opening and closing the toner supply port. The shutter member 20 includes a bottom portion 20*a* on which an opening portion 20*b* is formed , a to-be-pressed wall 20*c*, side walls 20*d* and a spring 20*e*. The to-be-pressed wall 20*c* is a side wall formed extending upward in the vertical direction at one end in the longitudinal direction of the bottom portion 20*a*. The side walls 20*d* are formed extending upward in the vertical direction at both ends in the shorter side direction of the bottom portion 20*a*. The spring 20*e* fixes to an inner wall 19*b* of the base portion main body 19 at one end and fixes to the to-be-pressed wall 20*c* at the other end. The opening portion 20*b* in the bottom portion 20*a* is formed at a position in which the opening portion 20*b* is not even partially in communication with the opening portion 41 of the base portion main body 19 in the vertical direction when not pressed by the shaft 30, and when pressed by the shaft 30, the opening portion 20*b* is in communication with the opening portion 41 in the vertical direction. The to-be-pressed wall 20*c* is a member that is directly pressed by the shaft 30, and transmits the pressing force of the shaft 30 to the spring 20*e* so that the spring 20*e* is contracted. The side walls 20*d* are fitted into guides (not shown) formed in the side face 19*c* of the base portion main body 19 so that the shutter member 20 is attached to the base portion main body 19 and the shutter member 20 moves back and forth in the direction shown by the arrow 50 in the FIGS. 1 and 2 along the guides. With the shutter member 20, when not pressed by the shaft 30, the opening portion 20*b* formed in the bottom portion 20*a* is not in communication with the opening portion 41 of the base portion main body 19, so that toner is not discharged from the opening portion 20*b*. On the other hand, when pressed by the shaft 30 so that the spring 20*e* is contracted and the opening portion 20*b* is communicated with the opening portion 41 in the vertical direction, toner can be discharged from the opening portion 20*b*.

The toner supply port 18 is formed on the bottom surface of the protective member 40. The toner supply port 18 is formed at a position that is matched with the opening portion 41 of the base portion main body 19 in the vertical direction. In other words, the toner supply port 18 and the opening portion 41 are positioned such that the two members can be in communication with each other. However, since the shutter member 20 is provided therebetween, the toner supply port 18 is prevented from being in communication with the opening portion 41. Therefore, even when the toner transport pipe 3 has received replenishment of toner from the toner hopper, the toner is not supplied to the developing bath 2. However, when the shutter member 20 is pressed by the shaft 30, the spring 20*e* is contracted and the opening portion 20*b* is displaced so that the toner supply port 18 is in communication with the opening portion 41, so that the toner is supplied to the developing bath 2.

It is preferable that the top portion 10, the toner transport portion 11 and the base portion 12 (base portion main body 19) of the toner transport pipe 3 are integrally formed into one piece. These components are made of synthetic resin or the like.

With the toner transport pipe 3, even when toner is supplied from the toner hopper (not shown), the toner can be temporarily stored in its inner space, and at the time when the shutter member 20 is pressed by the shaft 30, the toner is supplied from the toner supply port 18 to the developing bath 2 through the toner receiving port 38 of the developing bath 2.

As shown in FIGS. 1, 7A to 7C, the section 4 for opening and closing a toner supply port is configured including the shutter member 20, the shaft 30, a first spring member 26 (see FIG. 8), a second spring member 33 and a lever member 25. The shutter member 20 opens and closes a toner supply port 18 of the toner transport pipe 3. The shaft 30 is provided detachably to the shutter member 20 and moves the shutter member 20 in the direction shown by the arrow 50. The first spring member 26 is provided so as to abut against the shaft 30 and support the shaft 30 such that the shaft 30 can be attached to and detached from the shutter member 20 by its extension and contraction. The second spring member 33 is provided such that the shaft 30 is inserted in itw internal portion. The lever member 25 that is provided so as to be released and closed, abuts against the first spring member 26 when closed and extends and contracts the first spring member 26 by its releasing and closing.

As shown in FIG. 8, the first spring member 26 includes a pressing member 27, a supporting member 28 and a spring 29. The pressing member 27 is a rectangular solid member abutting against the shaft 30 at one end and supported by a supporting member 28 at the other end. The supporting member 28 supports the pressing member 27 and the spring 29. The spring 29 is fixed to the main body of the developing bath 2 at one end and supported by the supporting member 28 at the other end. The entire first spring member 26 is provided so as to support in the main body of the developing bath 2.

The lever member 25 is provided such that the lever member 25 is supported by the developing bath 2 so as to be released and closed in the direction shown by an arrow 51 in FIG. 1 at the side face of the end portion opposite to the end portion to which the toner transport pipe 3 is connected in the longitudinal direction of the developing bath 2, and that the face opposed to the side face of the developing bath 2 abuts against the supporting member 28 of the first spring member 26 when the lever member 25 is closed. By closing the lever member 25 (that is, the lever member 25 is allowed to be along the side face of the developing bath 2) or by opening the lever member 25 (that is, by keeping an interval between the lever member 25 and the side face of the developing bath 2), the spring 29 of the first spring member 26 is extended and contracted so that the shaft 30 is moved back and forth by the extension and contraction of the spring 29. A hook member 25*a* is formed on the face of lever member 25 opposed to the side face of the developing bath 2, and when the lever member 25 is closed, the hook member 25*a* is engaged with a hook receiving member (not shown) formed on the side face of the developing bath 2 so that the lever member 25 is fixed at that position. This engagement of the hook member can be released easily by applying a force oriented outward from the side face of the developing bath 2 to the end portion of the lever member 25, and therefore the lever member 25 can be easily released and closed.

The first spring member 26 is configured such that when the lever member 25 is closed, an upper portion of the portion of the pressing member 27 supported by the supporting member 28 abuts against the face of the lever member 25 opposed to the side face of the developing bath 2, the spring 29 is contracted gradually as the lever member 25 approaches the side face of the developing bath 2, the pressing member 27 is accordingly displaced in the direction shown by an arrow 52 in FIG. 8 to press the shaft 30. When the lever member 25 is released, the spring extends and the pressing member 27 and the supporting member 28 are accordingly displaced in the direction opposite to the arrow 52, so that the pressing member 27 is returned to a position at which the pressing member 27 abuts against or approaches the shaft 30, but does not press the shaft 30.

The shaft 30 is a shaft member that extends in the longitudinal direction of the developing bath 2, abuts against the shutter member 20 at one end and the first spring member 26 at the other end, and is supported by the developing bath 2 so as to move back and forth in the direction shown by the arrow 50. In other words, the shaft 30 is supported by a groove portion 2*a* formed extending in the longitudinal direction of the developing bath 2 on the surface of the developing bath 2 and supporting members 31 and 32 formed extending outward in the perpendicular direction from the surface of the developing bath 2. A though-hole (not shown) through which the shaft 30 is inserted is formed in the supporting member 32. The shaft 30 extending in the groove portion 2*a* is curved substantially at a right angle toward the direction perpendicular to the surface of the developing bath 2 before reaching the supporting member 32, and further curved substantially at a right angle toward the direction parallel to the surface of the developing bath 2 at the height of the unshown through-hole of the supporting member 32, inserted through the through-hole of the supporting member 32 and thus abuts against the shutter member 20 contained in the base portion 12 of the toner transport pipe 3. The shaft 30 presses the shutter member 20 by being pressed by the first spring member 26 so that the toner supply port 18 of the toner transport pipe 3 is in communication with the inner space of the toner transport pipe 3 to supply toner to the developing bath 2.

The second spring member 33 is provided between the supporting members 31 and 32 such that the shaft 30 is inserted therein. In particular, when the lever member 25 is released to release the pressing of shaft 30 against the shutter member 20, the second spring member 33 is used to bias the shaft 30 to the direction opposite to the direction in which the lever member 25 is pressed, and reliably close the toner supply port 18. It should be noted that the second spring member 33 is fixed to a position as shown in the drawing of the shaft 30 by a protrusion fixing member (not shown) that is formed on the surface of the shaft 30 so as to extend outward from that surface.

The shutter member 20 is such as described above.

With the section 4 for opening and closing a toner supply port, when the lever member 25 is closed, the first spring member 26, the shaft 30 and the shutter member 20 are operated in conjunction to open the toner supply port 18 formed on the bottom surface of the toner transport pipe 3 so that toner is supplied to the developing bath 2. On the other hand, when the lever member 25 is released, the pressing of the first spring member 26 and the shaft 30 in conjunction against the shutter member 20 is released so that the toner supply port is closed and the supply of toner to the developing bath 2 is stopped. Therefore, when toner remains in the toner hopper, the lever member 25 is closed, and image formation is performed while supplying toner to the developing bath 2. When toner in the toner hopper is used up and no toner remains, the lever member 25 is released for replacement of the toner hopper.

In other words, when toner remains in the unshown toner hopper, the lever member 25 is closed to maintain the pressing of the shaft 30 against the shutter member 20. When there is no toner left in the toner hopper and the toner hopper should be replaced, the lever member 25 is released before the empty toner hopper is removed, so that the pressing of the shaft 30 against the shutter member 20 is halted. After a new toner hopper is attached, the lever member 25 is closed and the developing bath 2 is replenished with toner and image formation is resumed. Therefore, the lever member 25 is released when image formation is stopped, and is closed at the time of image formation, and thus does not prevent the image formation operation.

With the developing apparatus 1, when toner hopper is replaced by a new one, the toner supply port 18 of the toner transport pipe 3 is closed, and therefore even if the toner transport pipe 3 is replenished with toner from the new toner hopper, the toner is temporarily stored in the toner transport pipe 3. Thereafter, when the lever member 25 is closed to open the toner supply port 18, the toner is supplied to the developing bath 2. By supplying toner in two divided stages in this manner, leakage or scattering involved in falling of toner can be significantly reduced, compared with a conventional developing apparatus in which toner is dropped at once from the toner hopper to the developing bath, and thus the contamination in the inner portion of the image forming apparatus due to toner can be prevented.

Figure 10:
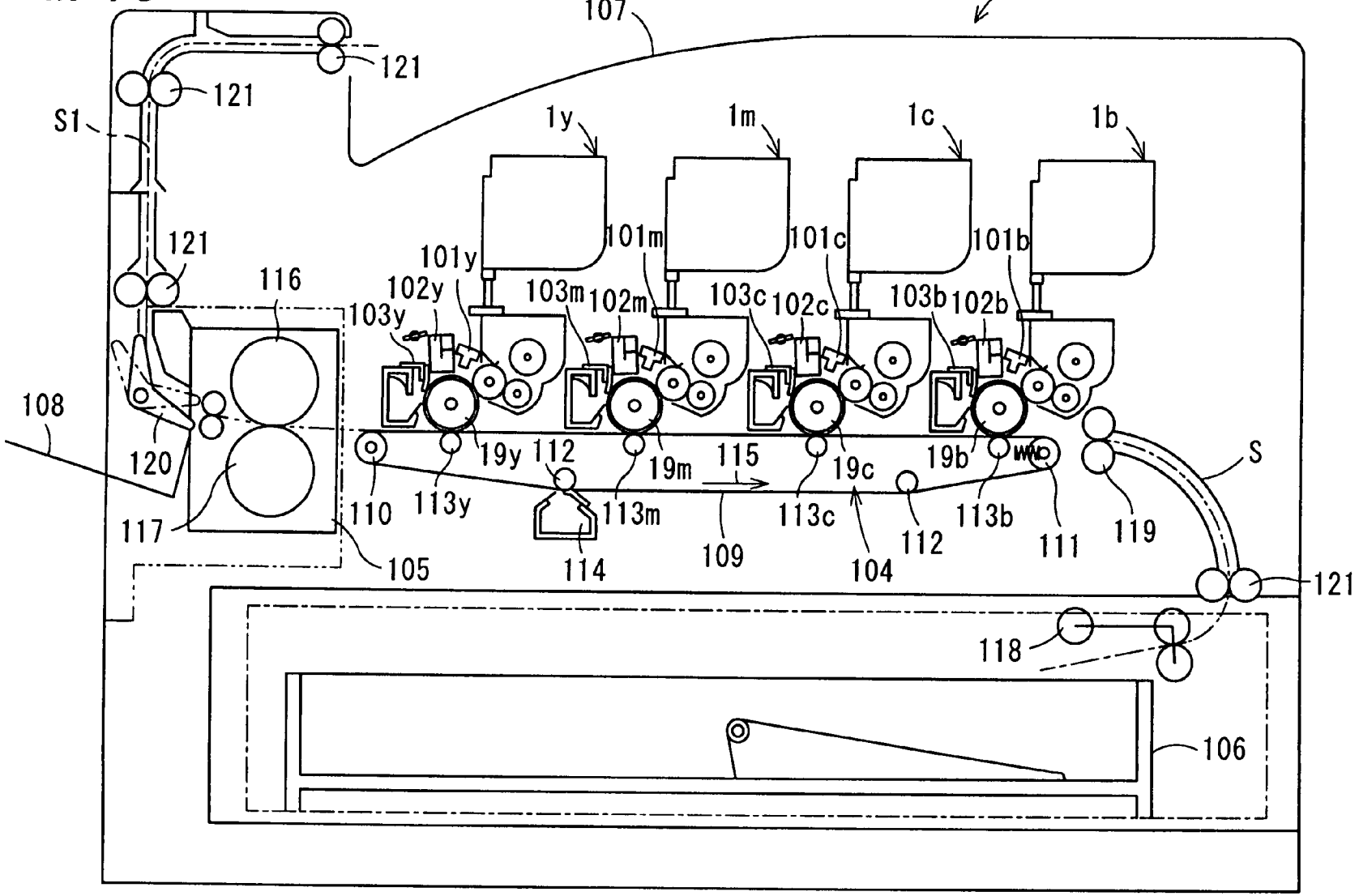
FIG. 10 is a schematic view showing the structure of an image forming apparatus according to another example embodiment provided with the developing apparatus of the invention.

FIG. 10 is a schematic view showing the structure of an image forming apparatus 100 according to another embodiment of the invention provided with the developing apparatus of the invention. The image forming apparatus 100 shown in FIG. 10 is, for example, an electrophotographic full color printer provided with the developing apparatus 1 according to the first embodiment of the invention.

The image forming apparatus 100 forms a full color or monochrome image on a recording medium such as recording paper in accordance with image information transmitted after being created, for example, in an external apparatus such as personal computers, and includes an exposure unit 101 (b,c, m,y), a developing apparatus 1, (b,c,m,y), an electrophotographic photoreceptor 19 (b,c,m,y), a charger 102 (b,c,m,y), a cleaning unit 103 (b,c,m,y), a transfer conveying belt unit 104, a fixing unit 105, paper conveying paths S and S1, a paper feeding tray 106, first and second paper discharge trays 107 and 108.

This image forming apparatus 100 is a full color printer in which image information is based on color images employing color components of black (b), cyan (c), magenta (m) and yellow (y). Therefore, the exposure unit 101, the developing apparatus 1, the electrophotographic photoreceptor 19, the charger 102, the cleaning unit 103, and the transfer roller 113 provided in a transfer conveying belt unit 104 are provided in number of four each, corresponding to the respective color components. Herein, the four components corresponding to the respective color components bear an alphabet that indicates a color, following a reference numeral for distinction, and when referring to the type of a component, the component is shown by a reference numeral.

The charger 102, the exposure unit 101, the developing apparatus 1, the transfer roller 113 and the cleaning unit 103 are arranged in this order around the electrophotographic photoreceptor 19. The charger 102 is charging section for uniformly charging the surface of the electrophotographic photoreceptor 19 to a predetermined potential, and either charger type, roller-type or brush-type can be used.

As the exposure unit 101, for example, a laser scanning unit provided with a laser irradiation portion and a reflective mirror can be used. The exposure unit 101 exposes the surface of the electrophotographic photoreceptor 19 that has been charged to a uniform potential to light in accordance with image information so that an electrostatic latent image is formed on the surface. The developing apparatus 1 supplies toner, which is a toner component, to the electrostatic latent image formed on the surface of the electrophotographic photoreceptor 19 to develop the image so that a toner image, which is a visible image, is formed. The cleaning unit 103 removes and collects toner that has not been transferred from the surface of the electrophotographic photoreceptor 19 to a recording medium and remains thereon from the surface of the electrophotographic photoreceptor 19.

The transfer conveying belt unit 104 is disposed below the electrophotographic photoreceptor 19 and includes a transfer belt 109, a transfer belt driving roller 110, a transfer belt tension roller 111, a transfer belt driven roller 112, a transfer roller 113 (b, c, m, y) and a transfer belt cleaning unit 114. The transfer belt 109 is tensioned by the transfer belt driving roller 110, the transfer belt tension roller 111, and the transfer belt driven roller 112, and the transfer belt 109 is driven to rotate in the direction shown by an arrow 115 by the rotation drive of the transfer belt driving roller 110.

The transfer belt 109 that is driven to rotate in the direction shown by an arrow 115 is provided in contact with each electrophotographic photoreceptor 19, and when a recording medium conveyed by the transfer belt 109 passes between the transfer belt 109 and the electrophotographic photoreceptor 19, the toner image formed on the surface of the electrophotographic photoreceptor 19 is transferred onto the recording medium. In the case of full color image, a toner image of each color component formed in the corresponding electrophotographic photoreceptor 19 is transferred sequentially and superimposed on the recording medium so that a full color image is formed. The transfer roller 113 is opposed to the electrophotographic photoreceptor 19 via the transfer belt 109. A transfer bias having a polarity opposite to the polarity with which the toner is charged is applied to the transfer roller 113, and this transfer bias allows the toner image on the surface of the electrophotographic photoreceptor 19 to be transferred on the recording medium.

The transfer belt cleaning unit 114 is provided in contact with the outer circumference of the transfer belt 109. Since the toner attached to the transfer belt 109 by an contact with the electrophotographic photoreceptor 19 may cause contamination of the back face of the recording medium, the transfer belt cleaning unit 114 removes and collects the toner on the surface of the transfer belt 109.

The fixing unit 105 is provided downstream from the transfer belt 109 in the direction to which the recording medium is conveyed, and includes a heating roller 116, a pressurizing roller 117,a heating source for the heating roller 116, a sensor for detecting the temperature of the heating roller 116 and a controller for controlling the operation of the heating source so that the heating roller 116 has a predetermined temperature. The heating roller 116 and the pressurizing roller 117 are provided so as to sandwich and convey a recording medium while being pressed against each other. The fixing unit 105 fixes the toner image on the recording medium by heating and pressurizing the toner image when the recording medium passes through a nip portion formed by the heating roller 116 and the pressurizing roller 117 so that the recorded image becomes solid.

The recording medium, for example, recording paper, on which the toner image is recorded is stored in the paper feeding tray 106. In the image forming apparatus 100 of this embodiment, the paper feeding tray 106 is provided in a lower portion of the apparatus. The recording paper stored in the paper feeding tray 106 is picked out one at a time from the paper feeding tray 106 by a pick-up roller 118 and sent out to the paper conveying path S. The recording paper sent out to the paper conveying path S is temporarily held by a registration roller 119 provided before an image forming portion constituted by including the electrophotographic photoreceptor 19 and the developing apparatus 1 in the conveying direction. The registration roller 119 conveys the recording paper to the image forming portion with a synchronized timing such that the front end of a toner image formed on the surface of the electrophotographic photoreceptor 19 matches the front end of the image formation range of the recording paper in accordance with a detection output of a pre-registration detection sensor (not shown).

A toner image is formed on recording paper in the image forming portion, and the recording paper with the toner image fixed by the fixing unit 105 is discharged to either a first paper discharge tray 107 or a second paper discharge tray 108, depending on a conveying direction switching guide 120 provided on the exit side of the fixing unit 105 that switches the paper discharge path. When the paper is discharged to the first paper discharge tray 107, the paper is discharged through the other paper conveying path S1. A conveying roller 121 is provided in the paper conveying paths S and S1 so that the recording paper on the path is conveyed in a predetermined direction.

Hereinafter, the image forming operation in the image forming apparatus 100 will be briefly described. The recording paper picked up from the paper feeding tray 106 by the pick-up roller 118 is sent out to the paper conveying path S, and held by the registration roller 119. Meanwhile, in the image forming portion, the surface of the electrophotographic photoreceptor 19 is charged with a uniform potential by the charger 102, an electrostatic latent image is formed by exposure in accordance with image information in the exposure unit 101, and a toner image is formed by the developing apparatus 1 developing the electrostatic latent image. The registration roller 119 sends out the recording paper to the transfer belt 109 with a synchronized timing such that the front end of the toner image formed on the surface of the electrophotographic photoreceptor 19 matches the front end of the image forming range of the recording paper.

In the course of conveying the recording paper by the transfer belt 109, a full color image is formed on the recording paper by transferring and layering a toner image of each color component sequentially from the corresponding electrophotographic photoreceptor 19. The recording paper on which the toner image is transferred is conveyed to the fixing unit 105, and subjected to fixing treatment in the fixing unit 105 to form a solid recording image, and then the paper is discharged to either the first or second paper discharge tray 107 or 108. Thus, a series of image forming operation ends.

In the image forming apparatus 100 is provided with the developing apparatus 1. Therefore, when it is detected that the end is near in the developing apparatus 1, the developing operation is stopped by stopping the rotation of the developing roller 24 and the stirring conveying member 42, and only the toner replenishing roller 30 is driven to rotate so that the developing bath 2 is replenished with toner from a replenishing container 29. Thus, the developing bath 2 is replenished with a sufficient amount of toner for developing, and even when blocking has occurred in the developing bath 2, blocking can be eliminated by pressure resulting from supply of toner for replenishment and a sufficient amount of toner is ready to be used.

With such an image forming apparatus 100, when the toner in the toner hopper is used up and the toner hopper is replaced by a new one, there is no possibility that toner contaminates the inner portion of the apparatus, so that high quality images can be formed continuously, and maintenance of the apparatus can be easily performed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing apparatus comprising:

a developing bath that receives supply of toner from a toner replenishing container;

a toner transport pipe provided between the toner replenishing container and the developing bath, in which a toner supply port for supplying toner to the developing bath is formed; and a toner supply port opening/closing mechanism for opening and closing the toner supply port while the transport pipe and the developing bath remain in essentially fixed positional relation; wherein the toner supply port opening/closing mechanism comprises:

a shutter member provided so as to be capable of moving back and forth in a direction perpendicular to an axis of the toner transport pipe, for opening and closing the toner supply port;

a shaft provided detachably to the shutter member, for moving the shutter member back and forth;

a first spring member provided in contact with the shaft, for supporting the shaft such that the shaft is detachable to the shutter member through its extension and contraction; and a lever member that is provided so as to be capable of being released and closed, that abuts against the first spring member when closed, and extends and contracts the first spring member through its releasing and closing.

2. The developing apparatus of claim 1, wherein the toner supply port opening/closing mechanism closes the toner supply port by separating the shaft from the shutter member at the time of releasing the lever member, and the toner supply port opening/closing mechanism opens the toner supply port by bringing the shaft into contact with the shutter member at the time of closing the lever member.

3. The developing apparatus of claim 1, wherein the toner supply port opening/closing mechanism comprises a second spring member that is provided such that the shaft is inserted therein, and that bias the shaft to separate from the shutter member at the time of releasing the lever member.

4. An image forming apparatus provided with the developing apparatus of claim 1.

* * * * *